US012655845B2

(12) United States Patent
Gutsche et al.

(10) Patent No.: US 12,655,845 B2
(45) Date of Patent: Jun. 16, 2026

(54) COMPRESSOR APPARATUS AND METHOD OF OPERATING THE SAME

(71) Applicant: KAESER KOMPRESSOREN SE, Coburg (DE)

(72) Inventors: Michael Gutsche, Coburg (DE); Annika Marx, Coburg (DE)

(73) Assignee: KAESER KOMPRESSOREN SE, Coburg (DE)

( * ) Notice: Subject to any disclaimer, the term of this patent is extended or adjusted under 35 U.S.C. 154(b) by 0 days.

(21) Appl. No.: 18/846,817

(22) PCT Filed: Mar. 6, 2023

(86) PCT No.: PCT/EP2023/055608
§ 371 (c)(1),
(2) Date: Sep. 13, 2024

(87) PCT Pub. No.: WO2023/174730
PCT Pub. Date: Sep. 21, 2023

(65) Prior Publication Data

US 2025/0207592 A1 Jun. 26, 2025

(30) Foreign Application Priority Data

Mar. 15, 2022 (DE) ..... 102022202574.1

(51) Int. Cl.
*F04C 29/04* (2006.01)
*F04C 18/16* (2006.01)
(Continued)

(52) U.S. Cl.
CPC ..... *F04C 29/04* (2013.01); *F04C 28/08* (2013.01); *F04C 29/026* (2013.01); *F04C 18/16* (2013.01)

(58) Field of Classification Search
CPC ..... F04C 29/04; F04C 28/08; F04C 29/026; F04C 18/16
See application file for complete search history.

(56) References Cited

U.S. PATENT DOCUMENTS 5,590,539 A 1/1997 Marohl et al.
5,967,757 A 10/1999 Gunn et al.
(Continued)

FOREIGN PATENT DOCUMENTS

CN 113007071 A 6/2021
DE 60115671 T2 7/2006
(Continued)

OTHER PUBLICATIONS

Translation (Year: 2025).*
(Continued)

*Primary Examiner* — J. T. Newton
(74) *Attorney, Agent, or Firm* — Millen, White, Zelano & Branigan P.C.; William F. Nixon

(57) ABSTRACT

The invention relates to a compressor apparatus comprising a screw compressor (3) capable of producing a compressed air-oil mixture; a compressor outlet (13); an oil separator (11) to which the compressed air-oil mixture is transferable and by means of which a compressed air and an oil from the compressed air-oil mixture are separable from each other and the compressed air is dischargable at the compressor outlet (13); an oil diversion duct (15), which connects the oil separator (11) to the screw compressor (3), wherein the oil diversion duct comprises a fan device (19) at an oil cooler (17); and a controller (21), by means of which a speed (n) of the fan (19) and thus also the cooling of the oil at the oil cooler (17) is adjustable.

15 Claims, 5 Drawing Sheets

(51) Int. Cl.
*F04C 28/08* (2006.01)
*F04C 29/02* (2006.01)

(56) References Cited

U.S. PATENT DOCUMENTS

| | | | |
|---|---|---|---|
| 7,059,837 | B2 | 6/2006 | Nichol et al. |
| 11,047,390 | B2 | 6/2021 | Kotani |
| 2016/0245273 | A1 | 8/2016 | Wagner |
| 2017/0298937 | A1 | 10/2017 | Seghers et al. |
| 2019/0242382 | A1 | 8/2019 | Kotani et al. |
| 2020/0240415 | A1 | 7/2020 | Kotani |

FOREIGN PATENT DOCUMENTS

| | | | | |
|---|---|---|---|---|
| DE | 10 2013 111 218 | A1 | 4/2015 | |
| JP | 2003-206864 | A | 7/2003 | |
| JP | 2005061402 | A | 3/2005 | |
| JP | 2015096731 | A | 5/2015 | |
| JP | 2017527740 | A | 9/2017 | |
| WO | WO-0246617 | A1 * | 6/2002 | ..... F04C 29/021 |
| WO | WO-2016041026 | A1 * | 3/2016 | ..... F04C 29/0014 |
| WO | 2018003211 | A1 | 1/2018 | |
| WO | 2018033827 | A1 | 2/2018 | |
| WO | WO-2023174730 | A1 * | 9/2023 | ..... F04C 29/04 |

OTHER PUBLICATIONS

International Search Report dated Jun. 13, 2023 issued in corresponding PCT/EP2023/055608 application (pp. 1-3).

European Patent Office Office Action dated Aug. 12, 2025 issued in the corresponding application 23710261.1 (with English Translation by Google Translate).

Japanese Patent Office Notice of Reasons for Refusal dated Sep. 24, 2025 issued in corresponding application 2024-554936.

* cited by examiner

Fig. 4

| No. | p [bar] | n [Upm] | T [°C] | P [kW*min/m3] |
|---|---|---|---|---|
| 1 | p1 | n1 | T1 | P1 |
| 2 | p1 | n1 | T2 | P2 |
| 3 | p1 | n1 | T3 | P3 |
| 4 | p1 | n2 | T1 | P4 |
| 5 | p1 | n2 | T2 | P5 |
| 6 | p1 | n2 | T3 | P6 |
| 7 | p2 | n1 | T1 | P7 |
| 8 | p2 | n1 | T2 | P8 |
| 9 | p2 | n1 | T3 | P9 |
| 10 | p2 | n2 | T1 | P10 |
| 11 | p2 | n2 | T2 | P11 |
| 12 | p2 | n2 | T3 | P12 |
| 13 | p3 | n1 | T1 | P13 |
| 14 | p3 | n1 | T2 | P14 |
| 15 | p3 | n1 | T3 | P15 |
| 16 | p3 | n2 | T1 | P16 |
| 17 | p3 | n2 | T2 | P17 |
| 18 | p3 | n2 | T3 | P18 |

71

73

71

73

71

COMPRESSOR APPARATUS AND METHOD OF OPERATING THE SAME

The present invention relates to a compressor apparatus and a method of operating the same.

The design of conventional compressor apparatus typically incorporates measures to mitigate the condensation of air humidity drawn into the compressor. However, the impact of cooling intensity on the compressor apparatus's specific output at the corresponding operational point is often overlooked or disregarded.

An expansion element may typically be installed, wherein the compression end temperature of an air-oil mixture is preset to a specific value. The set point can be configured to reduce the condensation of the sucked-in air humidity in the oil-injected screw compressor; however, it may be inefficient in terms of the intensity of cooling and the associated achievable specific output at the respective operation point.

The prior art document WO 0246617 A1 describes a method for controlling a compressor system, comprising at least one oil-cooled compressor element.

It is therefore the underlying object of the invention to provide a compressor apparatus and a method for operating the same, wherein the compressor apparatus can be operated with particularly high energy efficiency.

This task is solved by the features of the independent claims. Preferred further embodiments are disclosed in the dependent claims.

According to independent claim 1 there is provided:

a compressor apparatus comprising a screw compressor capable of producing a compressed air-oil mixture; a compressor outlet; an oil separator to which the compressed air-oil mixture is transferable and by means of which a compressed air and an oil from the compressed air-oil mixture are separable from each other and the compressed air is dischargable at the compressor outlet; an oil diversion duct, which connects the oil separator to the screw compressor, wherein the oil diversion duct comprises a fan device at an oil cooler; and a controller, by means of which a speed of the fan and thus also the cooling of the oil at the oil cooler is adjustable, wherein a current operation point of the compressor apparatus is determinable by means of the controller, wherein by means of a relation stored in the controller, in particular predetermined and/or determined in advance, an adjustable value for an oil-cooling parameter can be determined as a function of the determined current operation point, wherein the relation reflects the relationship between a plurality of operation points of the compressor apparatus and a plurality of adjustable values of the oil-cooling parameter, and wherein the determined value of the oil-cooling parameter is adjustable by means of the controller, in particular for operation of the compressor apparatus with a defined and/or low specific output.

Furthermore, according to independent patent claim 4 there is provided:

a method for operating a compressor apparatus comprising a screw compressor capable of producing a compressed air-oil mixture; a compressor outlet; an oil separator to which the compressed air-oil mixture is transferable and by means of which a compressed air and an oil from the compressed air-oil mixture are separable from each other and the compressed air is dischargable at the compressor outlet; an oil diversion duct, which connects the oil separator to the screw compressor, wherein the oil diversion duct comprises a fan device at an oil cooler; and a controller, by means of which a speed of the fan and thus also the cooling of the oil at the oil cooler is adjustable, wherein a current operation point of the compressor apparatus is determinable by means of the controller, wherein by means of a relation stored in the controller, in particular predetermined and/or determined in advance, an adjustable value for an oil-cooling parameter can be determined as a function of the determined current operation point, wherein the relation reflects the connection between a plurality of operation points of the compressor apparatus and a plurality of adjustable values of the oil-cooling parameter, and wherein the determined value of the oil-cooling parameter is adjusted by means of the controller, in particular for an operation of the compressor apparatus with a defined and/or low or minimum specific output.

It is thus possible to influence the intensity of the cooling of an air-cooled, fluid-injected compressor apparatus ("package") with at least one fan with variable speed for conveying variable quantities of cooling air through a cooler, with the aim of operating the machine at the respective operation point with the optimum (minimum) specific output, within predetermined limits. This mode of operation serves to reduce the energy consumption of the compressor apparatus. The compressor apparatus can be a single-stage or multi-stage compressor apparatus with at least one screw compressor driven at a fixed or variable speed.

The specific output of the compressor apparatus is calculated as the quotient of the total electrical power consumption of the compressor apparatus (dividend) and the delivered quantity (divisor) of the compressor apparatus. It should be noted that electrical power is consumed during operation by a number of components, including the controller, the drive of the fan device, and the drive of the screw compressor. The delivery volume may be defined as the volume flow of the compressed air produced, preferably downstream of the oil separator. The volume flow can be quantified through the use of an appropriate measuring apparatus.

The objective is to modify and adjust the intensity of the cooling process for the compressor apparatus by influencing the speed of the fan in a manner that optimizes the specific output of the compressor apparatus at the corresponding operational point, which is to say, it is brought as close to an optimal level (i.e. minimum) as possible. It is possible that upper and lower limits exist for the intensity of the cooling process due to external restrictions. These could include maximum permissible temperatures of components or operating materials, or minimum permissible temperatures to avoid condensation of sucked-in humidity in the compressor apparatus. The intensity of the cooling can be changed within these permissible limits, even if even higher or even lower intensities of cooling outside these limits could achieve further improvements in specific output.

According to a specific embodiment example, the compressor apparatus can have an air-cooled, single-stage, oil-injected screw compressor with variable drive speed of the screw compressor and variable-speed with fan for conveying variable amounts of cooling air through the fan device in the oil circuit.

In this embodiment, the operation point can be characterized by the pressure at the outlet of the compressor apparatus or the internal pressure (oil separator wet side) the of compressor apparatus, the speed of the screw compressor, the temperature and density of the available cooling air at its inlet to the screw compressor, the flow resistances for the cooling air t its inlet or outlet resulting from the installation conditions of the compressor, the current properties of the oil (e.g. viscosity class and viscosity index), the contamination condition of the oil separator cartridge and the contamination condition of the cooler. This operation point can result from external boundary conditions, the current ageing condition of components or operating materials in the compressor, the pressure or volume flow control method implemented in the compressor control system (delivery rate control method) and/or through control commands from a higher-level control system to the compressor control system. The operation point can be considered to be variable in time and predetermined at any point in time.

An increase in the fan speed causes a higher power consumption of the fan drive as well as an increase in the cooling air volume and thus a more intensive cooling of the compressor (in the specific embodiment: of the oil in the fan device). More intensive cooling also results in a reduction in the temperature at which the oil is injected into the screw compressor and the temperature at which the air-oil mixture leaves the screw compressor (compression end temperature, VET). Lower oil temperatures result in a higher operating viscosity of the oil and higher viscosity losses when transporting the oil through the screw compressor, which increases its required shaft power. A higher operating viscosity improves the sealing effect of the oil in the screw compressor and thus reduces the internal leakage losses in the compression process, which in turn has an effect on the delivery quantity and the required shaft power of the screw compressor.

The strength and the sign of the effect that an increase in the fan speed or an intensification of the cooling has on the delivery quantity and the required shaft power of the screw compressor depend on the current operation point and the current fan speed. For example, while an increase in the fan speed always results in an increase in the power consumption of the fan drive, an increase in the fan speed can-depending on the current operation point and current fan speed-increase or decrease the delivery quantity or the required shaft power of the screw compressor.

If the fan speed is reduced, similar effects occur with a different sign.

A change in the fan speed can have the following effects at the respective operation point:

- a change in the power consumption of the fan drive compressor
- a change in the required shaft power of the screw.
- a change in the power consumption of the fan drive Together, these variables are included in the specific output (quotient of the total electrical power consumption and the delivery volume) of the compressor apparatus. There is a fan speed at which the specific output of the compressor device is optimal, i.e. minimal, at the respective operation point when said effects are superimposed. This can be referred to as the optimum fan speed, which includes an optimum intensity of cooling, in particular an optimum VET or an optimum oil injection temperature.

The aim is to essentially adjust the optimum fan speed or the optimum intensity of the cooling, in particular the associated optimum VET, during operation of the compressor apparatus and to track the change in the operation point over time, provided that the intensity of the cooling remains within the permissible limits, or to come as close as possible to this optimum, provided that this is possible while complying with the permissible limits for the intensity of the cooling.

These permissible limits can be fixed or variable. An example of a fixed limit for the intensity of cooling can be a VET upper limit to counteract oil ageing.

In a preferred embodiment, the compressor apparatus has an oil temperature sensor between the fan device and the screw compressor. The compressor apparatus may have at least one air temperature sensor for the air drawn in by the screw compressor and/or the ambient air. The compressor apparatus may further comprise a temperature sensor for the temperature of the air-oil mixture, in particular at the outlet of the screw compressor. Furthermore, the compressor apparatus may also comprise a pressure sensor for the pressure of the air-oil mixture produced, in particular in or at the oil separator. The compressor apparatus may also comprise a a pressure sensor for the pressure of the compressed air produced, in particular downstream of the oil separator or at the compressor outlet. The controller can be connected to at least one of these sensors and set up to read them.

By means of the controller, several defined pressures can be adjusted for the compressed air produced by the compressor apparatus, in particular manually or automatically. For variable operation, several defined and/or variable speeds of the screw compressor can be adjusted by means of the controller. In doing so, the controller can, for example, approach different speeds depending on the pressure, which result from the compressed air requirement of the consumer. In a preferred method, a plurality, in particular two, of operation points of the compressor apparatus be can determined to determine the current operation point, with the relation reflecting the relationship between the operation parameters and the oil-cooling parameter. By considering two operation parameters characterizing the operation point in the relation, the operation can be optimized particularly easily and effectively.

To determine the current operation point, it is particularly preferable to determine the speed of the screw compressor as an operation parameter and the pressure of the air-oil mixture produced, in particular in or at the oil separator, as an operation parameter. Thus, the oil-cooling parameter is determined as a function of these two operation parameters via the relation. Determining the pressure of the air-oil mixture is advantageous here, as any increasing pressure loss of the oil separator, in particular of an oil separator cartridge of the oil separator, does not affect the pressure of the air-oil mixture or the pressure on the wet side of the oil separator.

Alternatively, it is also possible to determine the current operation point by determining the speed of the screw compressor as an operation parameter and the pressure of the compressed air produced downstream of the oil separator, in particular at the compressor outlet, as an operation parameter. The oil-cooling parameter is then determined as a function of these two operation parameters via the relation.

In principle, the oil-cooling parameter can be formed by the speed of the fan device assigned to the fan device, wherein the fan device is controlled in a defined manner by the controller to adjust the speed derived from the relation and thus the speed is adjusted.

Preferably, however, the oil-cooling parameter is formed by the temperature of the air-oil mixture produced, in particular at the outlet of the screw compressor, with the temperature of the air-oil mixture derived from the relation being adjusted and/or regulated by means of the controller and the fan device.

A particularly simple design can consist of modifying a control method for the VET, which is usually present in the compressor apparatus and uses the fan speed as a control variable. The modification consists of determining and using a setpoint value for the VET for the respective operation point, at the adjustment of which the optimum fan speed or the optimum intensity of cooling is adjusted, which belongs to the optimum or minimum specific output.

Alternatively, the oil-cooling parameter can also be formed by the oil temperature downstream of the oil cooler, in particular at the oil inlet of the screw compressor, wherein the oil temperature derived from the relation is adjusted and/or regulated by means of the controller and the fan device.

The relation can be designed as a formula, in particular derived from a performance map and/or mathematical formula. Preferably, the formula is a performance map approximation of a performance map determined in the test. Alternatively, the relation can also be designed as a performance map and stored in the controller.

For example, in order to determine the optimum VET setpoint for the respective operation point, the VET at which the specific output is optimum can be determined in test series for a plurality of operation points. A performance map can be created from the test series, from which the optimum setpoint value of the VET can be taken or calculated for each operation point, the adjustment of which by changing the fan speed results in a good approximation of the optimum specific output of the screw compressor. This performance map can be used to determine the optimum VET setpoint at the current operation point.

When deriving the performance map, individual variables characterizing the operation point, which have a comparatively small effect on the optimum intensity of cooling, can be omitted. For example, a method that works reliably in practice and achieves the optimum specific output to a good approximation can be obtained if the operation points are characterized only by the pressure at the outlet of the compressor apparatus and the speed of the screw compressor and fixed reference values are used for all other variables that characterize the operation point.

Examples of fixed reference values that can be used as a basis when creating the performance map can be the temperature of the available cooling air (the performance map to be created is referenced to a cooling air temperature of 20° C., for example) and a specific oil in its new condition (viscosity class and viscosity index).

In a preferred method, the temperature of the air drawn in by the compressor apparatus and/or the ambient air can be determined by means of the controller, wherein the oil-cooling parameter determined by means of the relation is corrected in accordance with a predetermined correction model, in particular in the form of a mathematical formula, which takes into account the determined air temperature, whereby it is preferably provided that the oil-cooling parameter corrected with the correction model is then adjusted by means of the controller. In this way, the current air temperature can be taken into account simply and effectively.

A disadvantage of embodiments based exclusively on performance maps can be that the method does not receive any feedback as to whether or to what quality the specification of setpoints based on performance map values actually leads to the adjustment of an optimum intensity of cooling or an optimum specific output. If relevant variables that characterize the operation point are not taken into account in the performance map, there may be relevant differences between the actual optimum cooling intensity at the respective operation point and the cooling intensity set on the basis of the performance map values, so that the actual specific output does not reach the optimum. If, for example, the temperature of the available cooling air is not taken into account when creating the performance map and the series of tests used to create the performance map are only carried out at a reference temperature, different temperatures of the available cooling air will have an effect on the cooling intensity set by the process when the process is carried out in reality. Series of tests show that at a higher temperature of the available cooling air and otherwise unchanged variables characterizing the operation point, the optimum specific output is adjusted at a higher VET, which in turn includes an optimum fan speed or an optimum cooling intensity.

If, for example, the current temperature of the available cooling air is to be taken into account, the target VET determined from performance be mathematically corrected at the operation point. As a first approximation, deviations from the reference temperature when calculating the target VET can be described as follows, $$VET_{Soll;korr} = VET_{Soll} + \left[ (t_a - t_r) * n/n_{max} \right]$$

if $t_a$ describes the temperature of the available cooling air and $t_r$ is the reference temperature at which the performance map was created and n is the speed of the screw compressor.

In a further preferred method, a search, in particular an iterative search, for a second, in particular optimum, value of the oil-cooling parameter, at which the compressor apparatus is operated with a lower specific output than at the first value of the oil-cooling parameter derived, in particular corrected, from the relation, can be carried out by means of the controller at the current operation point. In this way, an operating mode of the compressor apparatus with particularly low specific output can be achieved.

Preferably, if the second value was found during the search, this second value is adjusted by means of the controller at the current operation point.

In a preferred specific embodiment, for the, in particular iterative, search for the second value, a plurality of values for an oil-cooling parameter are adjusted by means of the controller, the specific output of the compressor apparatus being determined and/or estimated for each adjusted value by means of the controller.

If the oil-cooling parameter considered in the relation is the speed of the fan, several values can be adjusted for the fan speed when searching for the second value. If the oil-cooling parameter considered in the relation is the VET, several values can be adjusted for the VET or the speed of the fan when searching for the second value. If the oil-cooling parameter considered in the relation is the oil injection temperature, several values for the oil injection temperature or the speed of the fan can be adjusted when searching for the second value.

The iterative search can be implemented as follows, for example:

Starting from a starting point (e.g. the amount of $|VET_{Soll}-VET_{Ist}|<0.5$ K), iterative incremental changes to the intensity of the cooling can be carried out. Subsequently, the effect of the change steps on the specific output can be assessed and the next change step that is likely to improve the specific output can be determined on this basis. If, for example, the specific output has been improved (i.e. reduced) by the previous change step, in which the fan speed was increased by one speed increment, the fan speed can be increased again by one speed increment in the subsequent change step. Otherwise, the fan speed can be reduced by one speed increment. The size of a speed increment for changing the fan speed can be 20 rpm at the start of the iteration, for example. The amount of the speed increment can advantageously be adapted to the change in specific output observed in the previous change step in relation to the previous speed increment (step width control). This makes it advantageous to carry out small increments of change if the intensity of the cooling is close to the optimum, and large increments of change if the current intensity of the cooling is far from the optimum.

There are several alternatives for assessing the change in specific output in incremental iterative processes. For example, the total electrical power consumption and the delivery quantity of the screw compressor can be measured by suitable sensors and the measured values made available to the process. From this, the specific output can be calculated in the process as a quotient of the total electrical power consumption and the delivery quantity of the screw compressor. The assessment of the change then consists of a comparison of the specific outputs calculated on the basis of the measured values before and after the change step. Alternatively, these measured values can also be replaced in whole or in part by so-called "virtual sensors" or "virtual sensor values". These are values that are calculated or simulated on the basis of suitable models and represent a good approximation of the actual values of the physical variable, even if no measured values from real sensors are available or used for these physical variables. For example, conventional frequency inverters provide approximate values of the electrical power consumption of the frequency inverter via their interfaces, which are at least partially based on such "virtual sensors".

The compressor apparatus may advantageously also be characterized by the features and advantages already mentioned in the context of the method and vice versa.

BRIEF DESCRIPTION OF DRAWINGS

The invention is explained in more detail below with reference to the drawings, wherein these illustrate the following:

FIG. 4: a table explaining how to determine the performance map; and

FIG. 1 schematically shows a compressor apparatus 1. The compressor apparatus 1 has an oil-injected screw compressor 3 for producing compressed air. The compressor 3 is driven by a drive motor 5, which is designed here as an electric motor.

Figure 1:
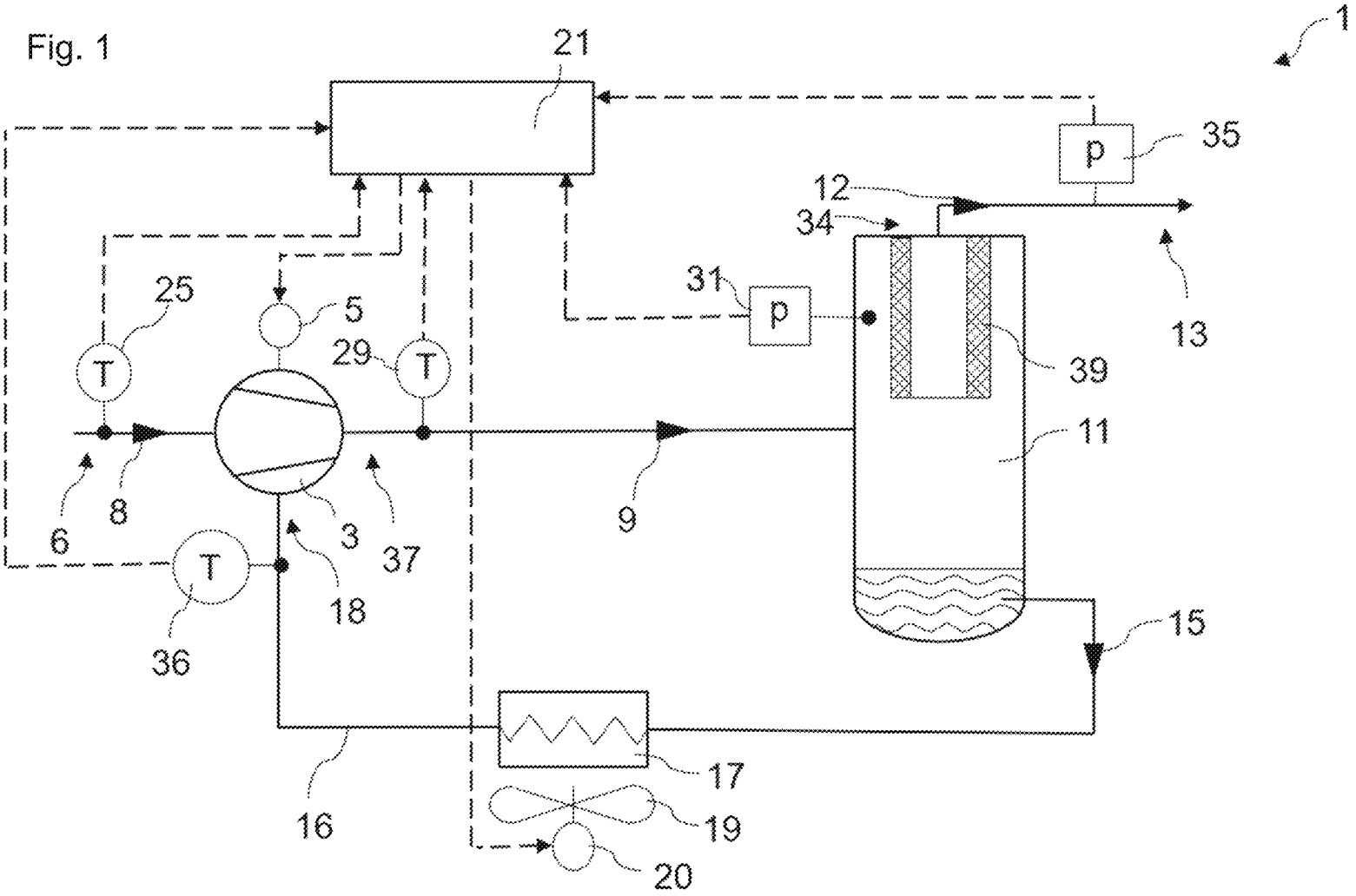
FIG. 1: a schematic representation of a first embodiment of a compressor apparatus according to the invention.

During operation of the compressor 3, air 8 is drawn in via an air inlet 6 and compressed in a compression chamber of the compressor 3 and mixed with oil. The air-oil mixture 9 flowing out of the compressor 3 is fed to an oil separator container as an oil separator 11 for separating oil from the produced compressed air. Starting from the oil separator 11, the compressed air 12 cleaned of oil is directed to a compressor outlet 13 of the compressor apparatus 1. A compressed air cooler, not shown in the figures, can also be arranged between oil separator 11 and compressor outlet 13 for cooling the produced compressed air. The separated oil 15 is fed back to the compressor 3 via an oil diversion duct 16 with a fan device 17 and injected into its compression chamber.

A fan device 19 is assigned to the fan device 17, via which cooling air can be conveyed to the fan device 17. The fan or ventilator 19 is driven here by a speed-controlled drive motor 20. The speed of the fan 19 can be variably adjusted with defined speed values via the controller 21 of the compressor system 1. In this way, the cooling air supplied by the fan 19 to the fan device 17 and thus the cooling of the oil 15 is also adjusted.

The speed of the screw compressor 3 can also be variably adjusted with defined speed values via the control unit 21. In addition, measured values from several sensors 25, 29, 31, 35, 36 are transmitted to the control unit 21.

By means of the temperature sensor 25, there is measured the temperature T of the air 8 drawn in by the screw compressor 3. As an alternative to the temperature of the air drawn in, the temperature of the ambient air can also be measured. The temperature sensor 29 is used to measure the temperature T (compression end temperature, VET) of the air-oil mixture 9 at the outlet 37 of the compressor 3. The pressure sensor 31 is used to measure the internal pressure p of the air-oil mixture 9 in the oil separator 11, viewed in the direction of flow, upstream of an oil separator element 39 or on the wet side of the oil separator 11. The pressure sensor 35 arranged downstream of the oil separator 11 is used to measure the pressure p of the compressed air produced at the compressor outlet 13 (final system pressure). In addition, the temperature sensor 36 measures the temperature T of the oil 15 downstream of the fan device 17 at the oil inlet 18 of the compressor 3 (oil injection temperature).

A relation in the form of a mathematical formula is also stored in the control unit 21. The formula is used to map or approximate a performance map 41 (FIG. 3) determined in a series of tests. The formula can be used by the control unit 21 to determine a compression end temperature (VET) as an oil-cooling parameter at which the compressor unit 1 is operated at its current operation point with a particularly low specific output and correspondingly with particularly high energy efficiency. This VET can be adjusted with the control unit 21 via the adjustable speed of the fan 19 and the temperature sensor 29.

Figure 3:
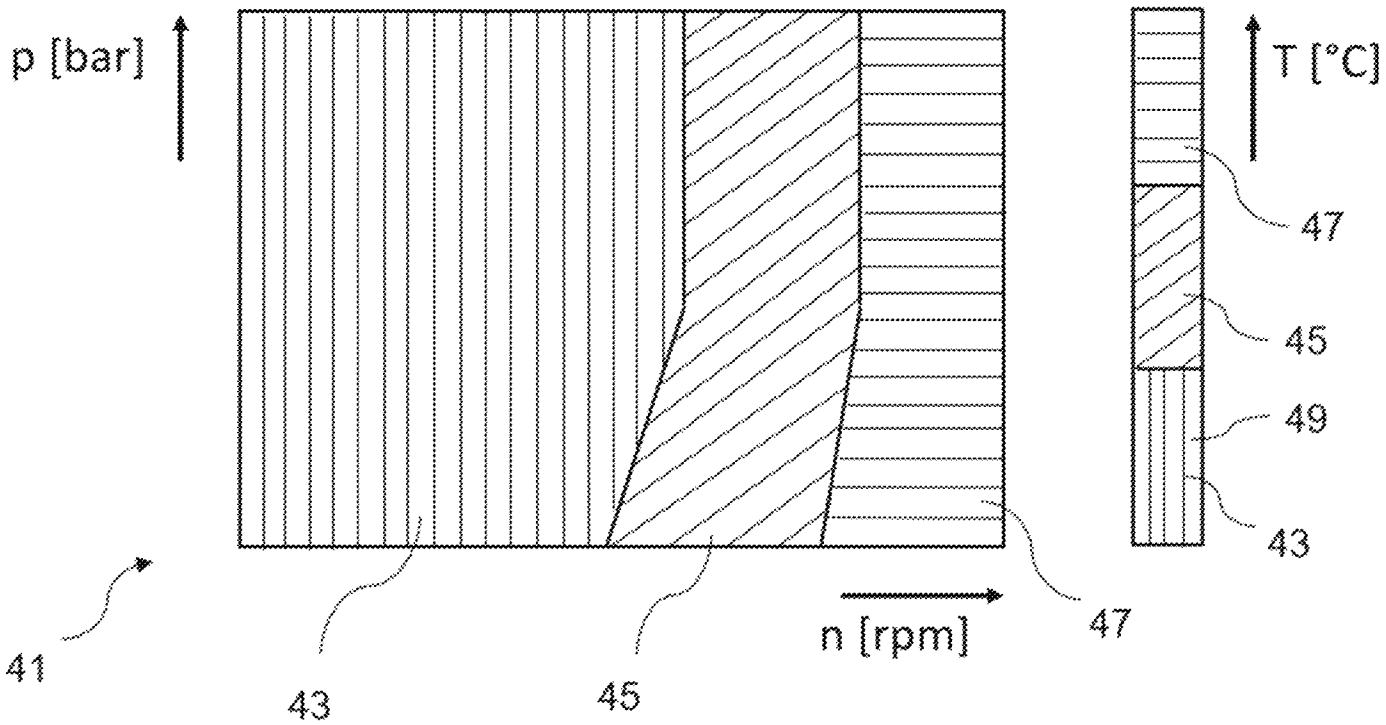
FIG. 3: a schematic representation of a performance map for the operation of the compressor apparatus.

According to FIG. 3, the internal pressure p of the air-oil mixture 9 in the oil separator 11 and the current speed n of the compressor 3 are entered in the performance map 41 as operation parameters that characterize the current operation point of the compressor apparatus 1. In principle, further or other operation parameters could also be taken into account in the performance map 41.

In the case of speed-controlled screw compressors, the current speed n of the screw compressor can already be available in the control system, wherein this value can be calculated in the frequency converter of the drive motor. It is also possible to measure the current speed n of the compressor 3 during operation.

The VET is also entered in the performance map 41. In the schematic representation of the performance map 41 in FIG. 3, three temperature ranges 43, 45, 47 of the VET are entered as examples with different hatching. The temperature ranges 43, 45, 47 are shown on the temperature scale 49.

The performance map 41 reflects the relationship between the operation parameters and the VET. Depending on the values of the operation parameters, the controller 21 can derive the assigned value of the VET from the performance map 41. The assigned value is the VET at which the compressor unit 1 is operated with a particularly low specific output at its current operation point. Depending on the pressure p and speed n, different VETs can thus result at which the compressor unit 1 is operated with a particularly low specific output.

It can also be seen from the performance map 41 that at a certain internal pressure p at a higher speed n, a VET is derived from the performance map 41 that is higher than the VET at a lower speed n. Thus, at a higher speed n, the control unit 21 adjusts or sets a higher VET than at a lower speed n in order to operate the compressor system 1 with a particularly low specific output.

It can also be seen from the performance map 41 that at certain speeds n at a higher internal pressure p, a VET is derived from the performance map 41 that is lower than the VET at a lower internal pressure p.

The mathematical formula stored in the control unit 21 for mapping or approximating the performance map 41 can be as follows, for example:

$$y(x;z) = P0 + P1*x + P2*x^2 + P3x^3 + P4*1/x + P5*z + P6*z^2 + P7*z^3 + P8*x*z$$

For y, this is the VET, for x, the speed n of the screw compressor 3 and for z, the internal pressure p. As an alternative to the formula, the performance map 41 can also be stored as a relation in the control unit 21.

As an alternative to the compression end temperature (VET), the oil injection temperature or the speed of the fan 19 can be taken into account as oil-cooling parameters in the performance map 41 or the formula.

As an alternative to the internal pressure p of the oil separator 11, the final system pressure p could be taken into account as an operation parameter in the relation.

An exemplary operation of the compressor apparatus 1 is explained with reference to FIG. 2:

First, the control unit 21 determines the $VET_{Soll}$ to be set in a step 51. Depending on the determined current internal pressure p and the determined current speed n of the screw compressor 3, the VET at which the compressor apparatus 1 is operated at a particularly low specific output is determined using the relation in the form of a formula. This determined VET is also referred to as $VET_{Soll}$. The $VET_{Soll}$ is determined continuously during operation of the compressor apparatus 1.

Subsequently, in a step 53, the control unit 21 checks whether an additional mathematical correction the of determined $VET_{Soll}$ should be carried out. One criterion as to whether a mathematical correction is carried out or not can be the deviation of the current temperature $T_a$ of the air drawn in from a defined reference temperature $T_r$, e.g. $|T_a - T_r| > 1K$ (Kelvin).

In certain operating situations, the mathematical correction can be used to determine a VET with higher energy efficiency than $VET_{target}$ derived from the formula at the current operation point, i.e. at the current internal pressure p and current speed n of compressor 3. If mathematical correction is required, a value $^{\Delta}VET_m$ is set to 0 K (Kelvin). If a mathematical correction is to be carried out, the value of $^{\Delta}VET_m$ is determined in a step 55 as a function of a defined reference temperature $T_r$, the current temperature $T_a$ of the air drawn in, the current speed n of the compressor 3 and a defined maximum speed $n_{max}$ of the compressor 3. For example, the following formula stored in the control unit 21 can be used as a correction model:

$$^{\Delta}VET_m = \left[ (T_a - T_r) * n/n_{max} \right]$$

The defined reference temperature $T_r$ is the temperature of the cooling air conveyed by the fan 19, which was selected in the series of tests to determine the performance map 41. It is also assumed that the current intake temperature $T_a$ of the compressor measured with the temperature sensor 25 corresponds to the current cooling air temperature of the compressor.

In steo 56 the controller 21 determined the value $VET_{Soll,\ korr1}$ from the sum of $VET_{Soll}$ and $^{\Delta}VET_m$:

$$VET_{Soll,korr1} = VET_{Soll} + {}^{\Delta}VET_m$$

Finally, in a step 57, the controller 21 checks whether an additional iterative search for a VET with a lower specific output (second VET value) than at $VET_{Soll,\ korr1}$ (first VET value) should be performed at the current operation point. The iterative search can be carried out, for example, if the compressor apparatus has the option of evaluating the effects of the different VET values to be set during the iterative search on the specific output of the compressor apparatus 1, for example using a suitable sensor system. If no additional iterative search is to be carried out, the value $^{\Delta}VET_i$ is set to 0 K. If an iterative search is to be carried out, the following condition is first checked in step 59:

$$|VET_{Soll,korr1} - VET_{Ist}| < 0,5\ \text{K (Kelvin)}$$

$VET_{Ist}$ is the current temperature of the VET measured with the temperature sensor 29. The value 0.5 K represents an exemplary value for a defined temperature difference. If the condition is fulfilled, the iterative search (iteration loop) is carried out in a step 61. If the condition is not fulfilled, no iterative search is performed, which would be the case, for example, after a speed change in load operation, which results in a new $VET_{Soll}$. In this case, the value of $^{\Delta}VET_i$ is set to 0 K.

In the iterative search, the specific output of the compressor apparatus 1 is determined in each case for different adjusted VETs. For this purpose, the electrical power consumption of the controller 21, the drive 5 of the compressor 3 and the drive 20 of the fan 19 as well as the delivery volume of the compressor apparatus 1 can be measured by means of a suitable sensor system during operation of the compressor apparatus 1.

For example, the iterative search can first determine the specific output at $VETSoll,_{korr1}$. The VET is then increased or decreased by defined values, with the specific output being determined at each set VET. Alternatively, the speed of the fan 19 could also be increased or decreased by defined values, with the specific output being determined at each set speed.

Finally, the VET is determined at which the specific output of the compressor apparatus 1 is comparatively lowest and thus the energy efficiency is highest.

The correction value $VET_i$ is derived from the result of the iterative search in step 63.

In a step 64, the controller 21 determines the value $VETS_{oll,\ korr2}$ from the sum of $VET_{Soll,\ korr1}$ and $VET_i$:

$$VET_{Soll,korr\ 2} = VET_{Soll,korr\ 1} + {}^{\Delta}VET_i$$

In addition, the control unit 21 checks whether the determined $VET_{Soll,\ korr2}$ is within the following permissible value range:

$$VET_{min} <= VET_{Soll;korr2} <= VET_{max}$$

$VET_{Soll,\ korr2}$ should not fall below a defined $VET_{min}$, which counteracts the formation of condensation in the compressor apparatus 1. $VET_{min}$ is determined by the control unit 21 depending on the temperature of the air drawn in and the relative humidity of the ambient air. In addition, $VET_{Soll}$, korr2 should not exceed a defined $VET_{max}$ in order to counteract a reduction in the quality of the oil 15. $VET_{max}$ is a constant value here. If $VET_{Soll,\ korr2}$ is not within the permissible value range, either $VET_{min}$ or $VET_{max}$ is defined as $VET_{Soll,\ korr2}$. If the value falls below $VET_{min}$, $VET_{min}$ is then set as $VET_{Soll,\ korr2}$, While if $VET_{max}$ is exceeded, $VET_{max}$ is set as $VET_{Soll}$.

In a step 65, the determined $VET_{Soll;\ korr2}$ is then transmitted to a VET-regulation device (VET controller) of the control unit 21. The speed of the fan 19 to be adjusted is determined via this in a step 67. This speed is adjusted in a step 69 via the drive motor 20 on the fan 19.

Figure 2:
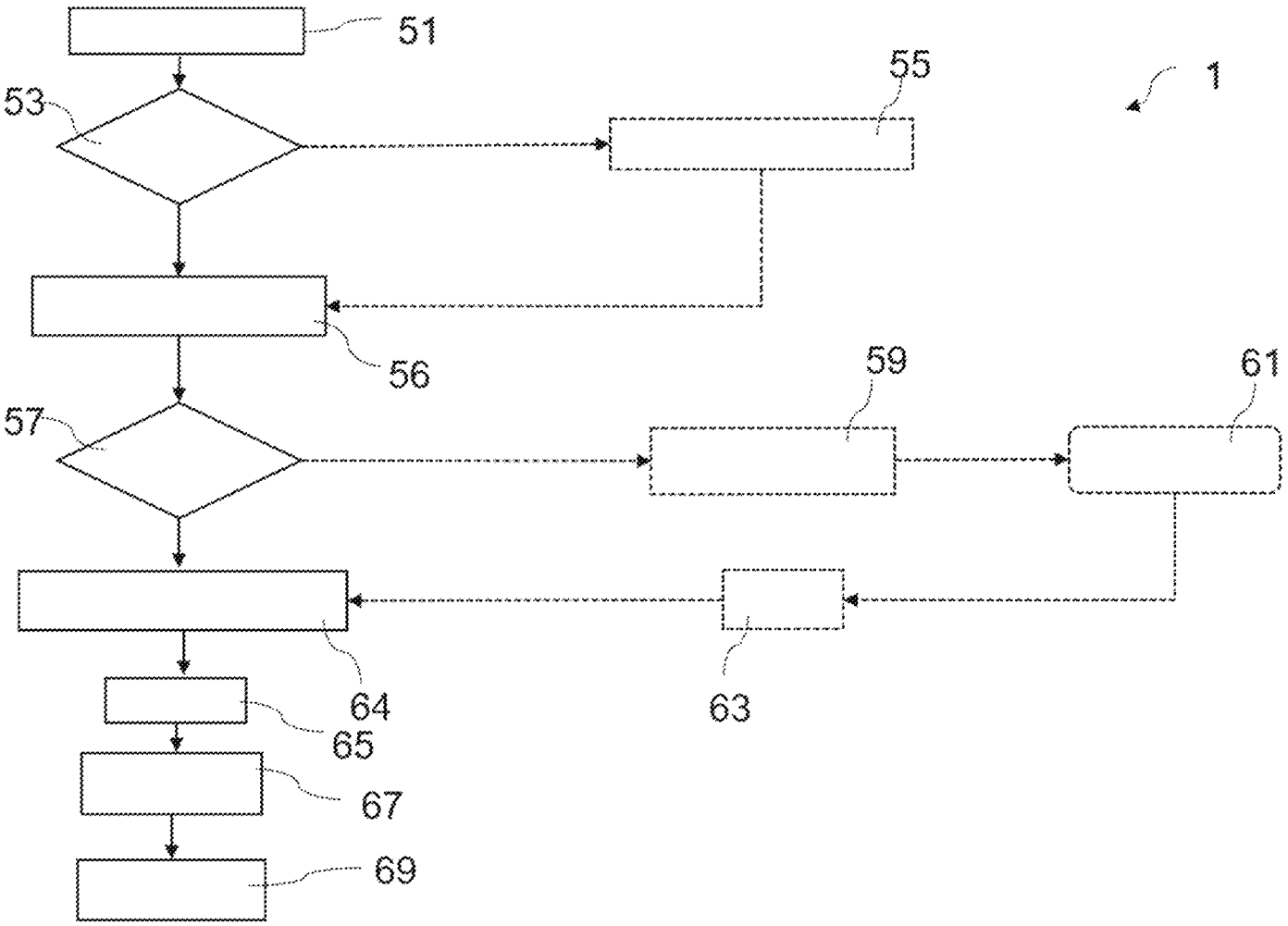
FIG. 2: a diagram explaining the operation of the compressor apparatus.

An operating mode similar to that of the compressor apparatus 1 according to FIG. 2 can be realized if the oil injection temperature is taken into account as an oil-cooling parameter in the formula as a relation instead of the VET.

FIG. 4 shows an example of how the performance map 41 is determined in a series of tests:

The test series are carried out at defined reference values. The reference values here are a defined temperature of the cooling air, which is conveyed to the fan device 17 by the fan 19, as well as the type and a defined condition, in this example new condition, of the oil 15 conveyed by the compressor unit 1.

According to FIG. 4, several measurements, in this example 18 measurements, are carried out in the test series to determine the specific output P of the compressor apparatus 1. Each determination of the specific output P is carried out at a different operation point of the compressor apparatus 1. The operation points set in the test series are also referred to as characteristic map points. The specific output P is the quotient of the electrical power consumption and the delivery volume of the compressor apparatus 1. To determine the specific output P, there are measured the electrical power consumption and the delivery volume of the compressor apparatus 1.

By way of example only, three measurement series 71 are carried out, each with 6 measurements at a defined pressure p1, p2 and p3 as the internal pressure p of the oil separator 11. In each measurement series 71, two exemplary measurement series 73 carried out, each are with 3 measurements at a defined speed n1, n2 as the speed n of the compressor 3. In addition, defined temperatures T1, T2 and T3 are adjusted as the compression end temperature T (VET) 73. Thus, each measurement for each measurement series results in a different operation point of the compressor apparatus 1.

After carrying out the measurements, it is determined at which operation points of the compressor apparatus 1 the specific output P of the compressor apparatus 1 is comparatively lowest and thus the energy efficiency is highest. It is therefore determined which VET must be adjusted at a given pressure p and a given speed n in order to achieve particularly energy-efficient operation of the compressor apparatus 1. The performance map 41 is created from these values.

Figure 5:
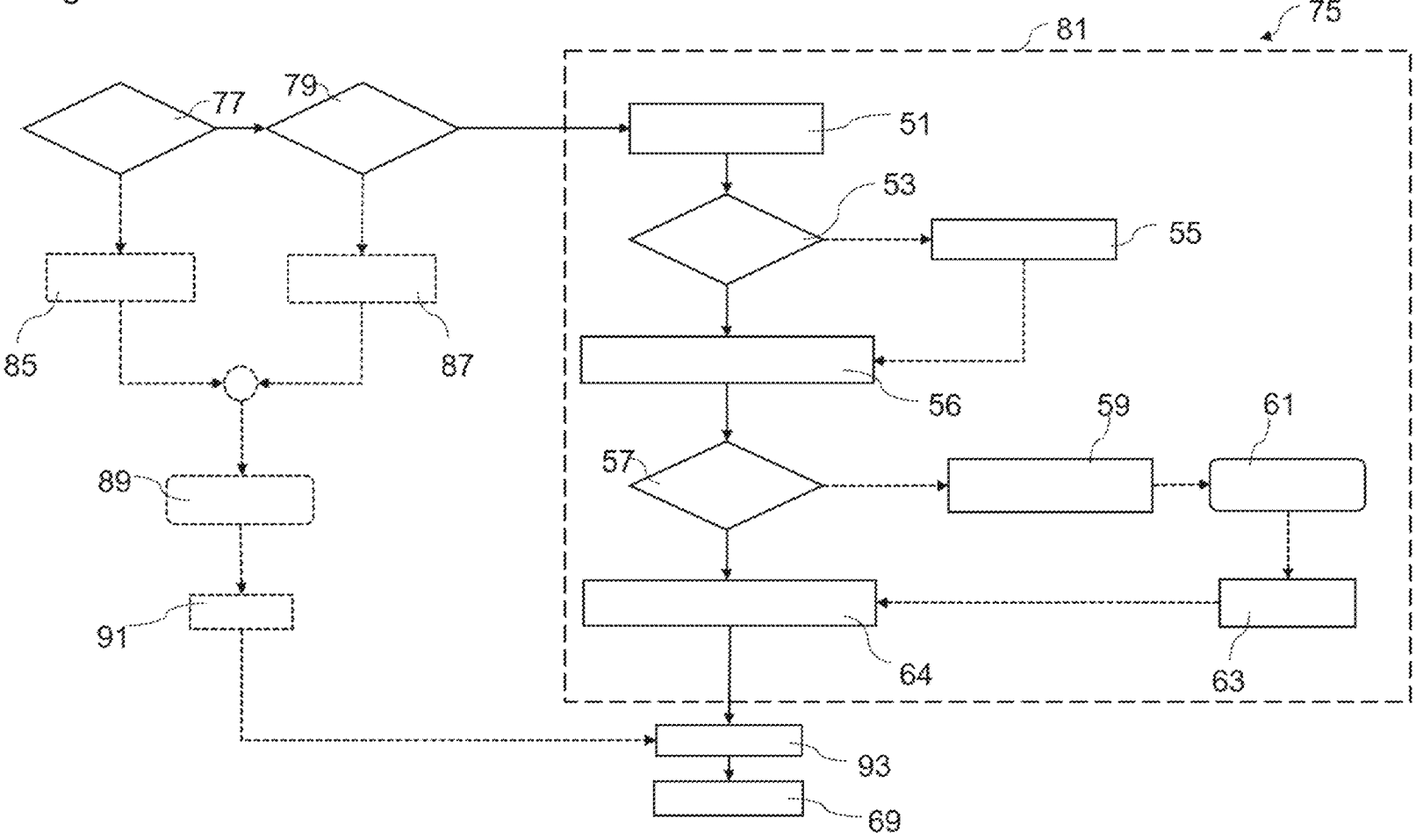
FIG. 5: shows a second embodiment of a compressor apparatus according to the invention as shown in FIG. 2

With reference to FIG. 5, an operating mode of an alternative compressor apparatus 75 is now explained.

In the case of the compressor apparatus 75, a mathematical formula is stored in the controller as a relation which reflects the relationship between the internal pressure of the oil separator 11 as an operation parameter, the speed of the compressor 3 as an operation parameter and the speed n of the fan 19 as an oil-cooling parameter. Depending on the values of the operation parameters, the control unit 21 can derive the assigned value of the speed n of the fan 19 from the formula. The assigned value of the speed n is the speed n of the fan 19 at which the compressor apparatus 75 is operated with particularly low specific output at its current operation point. This speed n of the fan 19 is also referred to as $n_{Soll}$.

In the following, only essential differences between the mode of operation of the compressor apparatus 75 and the compressor apparatus 1 are explained:

The fan speed $n_{Soll}$ derived from the relation is determined in step 51. From this, the speed value nL, $_{Soll,\ korr2}$, which is available after step 64, is determined in the speed determination 81 highlighted with dashed lines, similar to the compressor apparatus 1. The permissible value range for $N_{L,\ Soll,\ korr2}$ lies in a range from a defined maximum speed $n_L$, max/max to a defined minimum speed n, min.

In the step 59, the following condition is also checked for the compressor apparatus 75:

$$|{}^{\Delta}VET_{Ist}/\Delta t| <= 0,01\ \text{K/s}\ (\text{Kelvin/Sekunde})$$

$\Delta VET_{Ist}$ is the difference value by which the measured VETIst has changed in the defined time interval Δt. The value 0.01 K/s represents an exemplary value for a defined temperature change over time.

If the condition of step 59 is met, the iterative search for the speed n with higher energy efficiency than at $n_{Soll,\ Korr1}$ at the current operation point is carried out in step 61. The specific output at $n_{Soll,\ korr1}$ can be determined first. The speed is then increased or decreased by defined values, wherein the specific output is determined at each set speed.

If the condition is not met, no iterative search is performed, which would be the case, for example, after a speed change in load operation, which results in a new $n_{Soll}$ and the resulting VET is currently being adjusted.

Parallel or simultaneously to the continuous determination of $n_{L,\ Soll,\ korr2}$ in the speed determination 81, the controller continuously checks in step 77 whether the measured current VETIst fulfills the following condition:

$$VET_{ist} <= VET_{max}$$

If this condition is not met, the system continues with step 85. If the condition is fulfilled, the controller checks in step 79 whether the measured current $VET_{Ist}$ also fulfills the following condition:

$$VET_{ist} >= VET_{min}$$

If this condition is not met, continue with step 87.

$VET_{min}$ and $VET_{max}$ are the same values as for compressor apparatus 1. If it i determined in steps 77, 79 that the measured current VETIst is not within the permissible value range between $VET_{min}$ and $VET_{max}$, step 85 or step 87 is carried out by the control system, depending on the measured VET.

In step 85, $VET_{max}$ is specified by the control system as the $VET_{Soll}$ to be adjusted. In step 87, $VET_{min}$ is specified as the $VET_{Soll}$ to be adjusted. After specifying a $VET_{Soll}$ to be set in step 85 or 87, the VET-regulation device (VET regulator) of the control unit 21 is activated in step 89. In a subsequent step 91, the speed $n_{VET\ Regler}$ to be adjusted on the fan 19 is provided by the VET-regulation device.

Finally, the speed to be adjusted on the fan 19 is determined in a step 93. The speed $n_{VET\ Regler}$ provided by the VET-regulation device has priority over the speed $n_{Soll;\ korr2}$ determined in parallel from the speed determination 81.

Thus, if the VET-regulation device of the controller is deactivated (this applies if VETIst is within the permissible value range), the $n_{Soll,\ korr2}$ determined in step 65 is set as the speed of the fan 19 to be adjusted. If the VET-regulation device of the controller is activated (this applies if VETIst is not within the permissible value range), the speed $n_{VET\ Regler}$ provided in step 91 is set as the speed of the fan 19 to be adjusted. The speed determined in this way is adjusted in step 69 via the drive motor 20 on the fan 19.

As an alternative to using the VET-regulation device, if the $VET_{max}$ is exceeded, the speed of the fan 19 can simply be increased until a maximum speed $n_{max}$ of the fan 19 is reached. If the speed falls below the $VET_{min}$, the speed of the fan 19 is then reduced until a minimum speed $n_{min}$ of the fan 19 is reached.

What is claimed:

1. A compressor apparatus, comprising:

a screw compressor (3) capable of producing a compressed air-oil mixture;

a compressor outlet (13);

an oil separator (11), to which the compressed air-oil mixture is transferable, wherein a compressed air and an oil are separable from each other from the air-oil mixture and the compressed air is dischargable to the compressor outlet (13);

an oil diversion duct (15), connecting the oil separator (11) to the screw compressor (3), wherein the oil diversion duct comprises a fan device (19) provided at an oil cooler (17); and a controller (21), wherein a speed (n) of the fan device (19) and thus also the cooling of the oil at the fan device (17) is adjustable, wherein a current operation point of the compressor apparatus (1) is determinable by the controller (21), wherein based on a relation (41) stored in the controller (21), in particular predetermined and/or determined in advance, an adjustable value for an oil-cooling parameter can be determined as a function of the determined current operation point, wherein the relation (41) reflects the relationship between a plurality of operation points of the compressor apparatus (1) and a plurality of adjustable values of the oil-cooling parameter, and wherein the determined value of the oil-cooling parameter is adjustable by means of the controller (21), in particular for operation of the compressor apparatus (1) with a defined value of a specific output or within a predefined range from a minimum value of the specific output, the specific output comprising a quotient of a total electrical power consumption of the compressor apparatus and a volume flow of compressed air produced.

2. The compressor apparatus according to claim 1, comprising an oil temperature sensor (36) between the fan device (17) and the screw compressor (3) and/or at least one air temperature sensor (25) for the air drawn in by the screw compressor (3) and/or the ambient air and/or a temperature sensor (29) for the temperature of the air-oil mixture, in particular at the outlet (18) of the screw compressor (3), and/or a pressure sensor (31) for the pressure of the air-oil mixture, in particular in or at the oil separator (11), and/or a pressure sensor (35) for the pressure of the compressed air produced, in particular downstream of the oil separator (11) and/or at the compressor outlet (13), and wherein the controller (21) is connected to at least one of these sensors and is set up for the reading thereof.

3. The compressor apparatus according to claim 1, characterized in that several defined and/or variable speeds of the screw compressor (3) are adjustable by the controller (21), and/or in that several defined pressures for the compressed air produced by the compressor apparatus (1) are adjustable by the controller (21).

4. A method for operating a compressor apparatus the method comprising:

producing an air-oil mixture by a screw compressor (3);

transferring the air-oil mixture to an oil separator (11);

separating a compressed air and an oil from the air-oil mixture by the oil separator;

discharging the compressed air at a compressor outlet (13) of the compressor apparatus, wherein the compressor apparatus includes an oil diversion duct (15) connecting the oil separator (11) to the screw compressor (3), wherein the oil diversion duct comprises a fan device (19) at an oil cooler (17);

adjusting a speed of the fan device (19) by a controller (21) and thus also adjusting the cooling of the oil at the fan device (17);

determining by the controller (21) a current operation point of the compressor apparatus (1);

determining by a relation (41) stored in the controller (21), in particular predetermined and/or determined in advance, an adjustable value for an oil-cooling parameter as a function of the determined current operation point, wherein the relation (41) reflects the relationship between a plurality of operation points of the compressor apparatus (1) and a plurality of adjustable values of the oil-cooling parameter; and adjusting the determined value of the oil-cooling parameter by the controller (21), in particular for operation of the compressor apparatus (1) with a defined value of a specific output or within a predefined range from a minimum value of the specific output, the specific output comprising a quotient of a total electrical power consumption of the compressor apparatus and a volume flow of compressed air produced.

5. The method according to claim 4, wherein, in order to determine the current operation point, determining a plurality of, in particular two, operation parameters (p, n) of the compressor apparatus (1), wherein the relation (41) reflects the relationship between the operation parameters (p, n) and the oil-cooling parameter.

6. The method according to claim 4, wherein, in order to determine the current operation point, determining as operation parameters the speed (n) of the screw compressor (3) and the pressure (p) of the air-oil mixture produced, in particular upstream of the oil separator (11) or in the oil separator (11).

7. The method according to claim 4, wherein to determine the current operation point, determining as operation parameters the speed (n) of the screw compressor (3) and the pressure of the compressed air produced, in particular downstream of the oil separator and/or at the compressor outlet.

8. The method according to claim 4, wherein the oil-cooling parameter is formed by the speed of the fan device (19) associated with the fan device (17), wherein the fan device (19) is controlled by the controller to set the speed derived from the relation.

9. The method according to claim 4, wherein the oil-cooling parameter is formed by the temperature of the air-oil mixture produced, in particular at the outlet (37) of the screw compressor (3), and further comprising adjusting and/or regulating the temperature derived from the relation (41) by the controller (21) and the fan device (19).

10. The method according to claim 4, wherein the oil-cooling parameter is formed by the oil temperature downstream of the oil cooler (17), in particular at the oil inlet (18) of the screw compressor (3), and further comprising adjusting and/or regulating the oil temperature derived from the relation by the controller (21) and the fan device (19).

11. The method according to claim 4, wherein the relation (41) is designed as a formula, in particular derived from a performance map and/or mathematical formula, or as a performance map.

12. The method according to claim 4, wherein the temperature of the air drawn in by the compressor apparatus and/or the ambient air is determined by the controller (21), further comprising correcting the oil-cooling parameter determined by the relation according to a predetermined correction model, in particular in the form of a formula, which takes into account the determined air temperature, and adjusting the oil-cooling parameter corrected by the correction model by the controller (21).

13. The method according to claim 4, further comprising by the controller (21) at the current operation point a search, in particular an iterative search, carrying out for a second, in particular optimum, value of the oil-cooling parameter at which the compressor apparatus (1) is operated with a lower specific output than at the first value of the oil-cooling parameter derived from the relation, in particular corrected with the correction model.

14. The method according to claim 13, wherein, if the second value is found during the search, adjusting this second value by the controller (21) at the current operation point.

15. The method according to claim 13, further comprising for the, in particular iterative, search for the second value, adjusting a plurality of different values for an oil-cooling parameter by the controller (21), and at each adjusted value, by the controller (21), determining the specific output of the compressor apparatus (1).

* * * * *